US006569588B2

(12) United States Patent
Oikawa et al.

(10) Patent No.: US 6,569,588 B2
(45) Date of Patent: May 27, 2003

(54) ELECTROPHOTOGRAPHIC TONER, PRODUCTION METHOD THEREOF AND ELECTROPHOTOGRAPHIC IMAGE FORMING SYSTEM

(75) Inventors: Akiko Oikawa, Hitachi (JP); Akira Shimada, Hitachi (JP); Toru Miyasaka, Hitachi (JP); Masahiko Saito, Kitaibaraki (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/791,554

(22) Filed: Feb. 26, 2001

(65) Prior Publication Data

US 2002/0110747 A1 Aug. 15, 2002

(30) Foreign Application Priority Data

Dec. 19, 2000 (JP) ..... 2000-385412

(51) Int. Cl.[7] ..... G03G 9/087; G03G 9/097

(52) U.S. Cl. ..... 430/108.1; 430/109.4; 430/110.1; 430/137.21; 430/99

(58) Field of Search ..... 430/108.1, 108.8, 430/109.3, 110.1, 110.4, 137.21, 99

(56) References Cited

U.S. PATENT DOCUMENTS

| | | | | | |
|---|---|---|---|---|---|
| 5,518,851 | A | * | 5/1996 | Katagiri et al. | 430/104.1 |
| 5,573,881 | A | * | 11/1996 | Kawasaki et al. | 430/108.8 |
| 5,908,727 | A | * | 6/1999 | Kawaji et al. | 430/109.3 |
| 6,080,519 | A | * | 6/2000 | Ishiyama et al. | 430/110.4 |
| 6,171,746 | B1 | * | 1/2001 | Natsuhara et al. | 430/111 |

* cited by examiner

*Primary Examiner*—John Goodrow
(74) *Attorney, Agent, or Firm*—Antonelli, Terry, Stout & Kraus, LLP

(57) ABSTRACT

A toner for use in a color electrophotographic system ensures a sufficient offset resistance without oil being supplied, and meets requirements for color development, transparency and durability to withstand commercial use. The toner for an electrophotographic system has a resin 1 consisting of two or more resin mixtures having a different degree of crosslinking, the overall occupancy rate of mold releasing agent 3 present as a domain in one particle of the toner is 1 to 10%, and the average dispersion diameter of the mold releasing agent is 10 to 50% of the toner particle diameter.

8 Claims, 2 Drawing Sheets

ELECTROPHOTOGRAPHIC TONER, PRODUCTION METHOD THEREOF AND ELECTROPHOTOGRAPHIC IMAGE FORMING SYSTEM

The present invention relates to the electrophotographic toner used in a printer, a facsimile machine and a copier, and to the image forming system using said toner. It relates particularly to color toner wnich does not require use of an oil or other anti-offset agent for the fusing device.

Recent improvements in computer processing capability have been accompanied by a quick expansion of the color printer market. Full-color image formation by electrophotography reproduces all colors, using the three colors of yellow, magenta and cyan, or four colors with black added thereto.

According to common practice, an electric latent image is formed on a photoconductor layer using a photoconductive substance. Then the latent image is developed by color toner, and the toner image is transferred onto a recording media, such as paper by an intermediate transfer unit. This is followed by the step of repeating the above-mentioned process several times for successive colors, thereby allowing multiple toner images of the different colors to be superimposed on the same recording media. In the final step, the toner image is fused onto the recording media in one operation by heating, pressure, thermal compression or solvent steam, thereby forming a full-color image.

In the color electrophotographic system requiring superimposition of multiple color toner images, toner fusing characteristics are very important. In the case of monochrome photography, fusing characteristics are evaluated only on the basis of the degree of sticking onto the recording media.

In the case of color photography, on the other hand, sticking onto the recording media alone is not sufficient to ensure an extensive color reproducibility. It is necessary to obtain gloss and transparency by sufficient melting (lower viscosity). This makes it necessary to use a Sharp Melt resin as the color toner, namely, a low molecular resin characterized by narrow distribution of molecular weight.

However, toner using such a resin is likely to have its internal condensation reduced at the time of heating and melting. Therefore, when it passes through the fusing device, it is more likely to stick to the fusing member. This will lead to vulnerability to an offset phenomenon.

To avoid this problem, in the fusing device commonly used for fusing color toner, silicone oil and other mold releasing agents are applied to the surface of the heating member of a roll or the like, thereby reducing adhesion between the molten toner and the heating material.

This method is very effective in preventing the offset phenomenon. However, the mechanism requires a complicated system of bigger size. Further, this method inherently has many problems, for example, reduction in handling properties due to deposition of oil on the recording media, and contamination of the system interior due to oil volatilization, not to mention the oil supplying time and labor and increased running costs. These factors make it difficult to achieve a smaller size, a lower price and a maintenance-free system.

To solve these problems, extensive studies have been made to develop a method of adding in the toner particles a wax which melts earlier than the resin without melting with the toner resin, or a mold releasing agent such as oil, instead of using the oil feeding device. Namely, when a mold releasing agent having a lower melting point than that of the resin is used, the mold releasing agent will melt before the resin melts and start flowing so as to ooze from the toner, and so a mold releasing layer is formed between the toner layer and fusing roller surface, thereby preventing the offset phenomenon.

If a highly viscous resin is used as in the case of a conventional monochrome toner, the internal coagulation is higher when the toner melts, and deposition onto the fusing member is smaller. This makes it possible to prevent the offset phenomenon with a small amount of oozing of the mold releasing agent. However, in the case of a color toner, heating and melting are accompanied by a greater reduction in the internal coagulation and a higher deposition on the fusing member. Not only that, a sufficient amount of mold releasing agent is required to ooze from the reduced internal coagulation. This makes it difficult to prevent the offset phenomenon.

If the amount of mold releasing agent is simply added, there will be an increase in the offset resisting effect, but the following problems occur if a great deal of mold releasing agent is added to the color toner:

(1) Resin and a mold releasing agent are incompatible with each other, so scattering occurs on the boundary, resulting in greater vulnerability to reduction in color tone and transparency.

(2) The mold releasing agent has the effect of a plasticizer on the resin, and decreases the resin strength and toner durability and toner durability.

(3) When the toner is kneaded, the mold releasing agent dissolves to decrease the effect of the kneading. This deteriorates the dispersibility of internal additives including the mold releasing agent.

Since a soft resin is used for color toner, the durability generally tends to be inferior to that of the conventional monochrome toner. This characteristic is made more marked by addition of the mold releasing agent. This gives rise to many problems, including deterioration of the toner flowing properties, and decrease in toner transportability, as well as sticking of toner to the blade in the non-magnetic component development method. Further, the mold releasing agent tends to cause filming on other members, such as the photoconductor, and this has been a problem to be solved.

These problems are caused not only by the amount of mold releasing agent added, but also by the physical state of the mold releasing agent in the toner. For example, if the mold releasing agent is poorly dispersed, the mold releasing agent is separated in the pulverization process in toner production and excessive exposure on the toner surface occurs.

As described above, the biggest technological issue for oil-free color toner is how to maintain durability, color development and transparency, and to improve the offset resistance.

In an effort to solve the foregoing problems, many proposals have been made to define the toner composition and the physical state of the mold releasing agent to be added in the toner.

For example, Japanese Official Patent Gazette No. 161153/1994 <1>discloses a production method ensuring uniform distribution of mold releasing agents having a small diameter in the kneading and pulverization process. According to this method, the mold releasing agent in produced toner particles is said to exhibit a uniform dispersion in a spherical form having a dispersion diameter of 0.2 to 3.0 $\mu$m, and/or in the form of a spindle with a major axis of 1.0 to 4.0 $\mu$m. Without separation of the mold releasing agent, the agent is said to prevent filming on the photoconductor based thereon. The melting point of the mold releasing agent is preferred to be 90 to 180° C., and more preferably to be 110 to 160° C.

The Japanese Official Patent Gazette 69125/1998 (<2>) also discloses the uniform dispersion of a mold releasing agent. It defines the dispersion of the mold releasing agent in terms of the ratio of the mold releasing agent contents in a fine powder toner and the entire toner. The disadvantage of the toner due to addition of said mold releasing agent is overcome by keeping the ratio within a specified range. This provides toner characterized by excellent offset resistance, according to this publication.

To overcome the difficulties of toner containing a mold releasing agent, many toner preparation methods based on a so-called wet process have been proposed. For example, Japanese Official Patent Gazette 197193/1993 (<3>) discloses a capsule structure toner produced by a suspension polymerization method. This capsule structure toner makes it possible to reduce the amount of mold releasing agent exposed to the surface. This provides an easier solution to the problems, including deterioration of durability, filming properties and development characteristics, by addition of the mold releasing agent.

As described above, separation of the mold releasing agent or the adverse affect on other processes thereby can be minimized by uniform dispersion or encapsulation of the mold releasing agent.

According to the technique disclosed in Official Patent Gazette (<1>), however, the melting point of the mold releasing agent is preferred to be90° C. or more (most preferably 110° C. or more). This is applicable to a monochrome system, but not applicable to a color electrophotographic system where a soft resin is suitable.

Furthermore, the technique disclosed in Official Patent Gazette (<2>) is concerned with only the contents of the mold releasing agent, without any mention being made of dispersion diameter. The action of the mold releasing agent greatly depends on the state of dispersion, as well as the above-mentioned contents.

For example, the following has been confirmed: When the dispersion diameter is small, oozing of the mold releasing agent is not sufficient at the time of fusing even if the contents are sufficient, and so that offset phenomenon cannot be prevented. As described above, in the case of color toner, it is more difficult to prevent the offset phenomenon than in the case of a conventional monochrome toner. This is insufficient for an oil-free color toner.

The capsule structure toner disclosed in the Official Patent Gazette <3> is characterized by easy delay of the mold releasing agent in the dispersion to the boundary. This results in a smaller contribution of the mold releasing agent to the resistance against the offset phenomenon. This requires a greater amount of mold releasing agent to be added.

There is a concern over possible reduction in color tone and transparency, as well as possible impact on durability. This may offset the advantages gained by encapsulation.

In the above-mentioned preparation method, the polymerizable monomer composition of the resin to be formed into the toner is restricted to styrene, a polymer thereof and a polymerizable monomer which allows polymerization of a solution typically exemplified by α-methylene aliphatic monocarboxylic acid ester. This leads to the.problem that the polyester resin suited for use in conventional color toner is difficult to use. Further, this requires a special production plant and is more disadvantageous than the conventional kneading and pulverization method.

As is clear from the above, many technologies have been proposed regarding oil-free color toner, particularly the mold releasing agent to be added thereto, and the physical state thereof. In spite of such efforts, a color electrophotographic toner featuring excellent durability, gloss, color development and transparency, as well as a sufficient offset resistance, has not yet been obtained.

In view of the above, the main object of the present invention is to provide a new electrophotographic toner which does not require oil to be fed to a fusing system and which is suited to small-sized and maintenance free copiers and printers.

Another object of the present invention is to provide a color electrophotographic toner wherein consideration is given to the physical state of the resin as a toner constituent and the mold releasing agent added to the toner, thereby ensuring excellent melting and fusing properties, superb gloss, color development and transparency of the image, and a surpassing durability and offset resistance.

SUMMARY OF THE INVENTION

In accordance with the present invention, the electrophotographic toner used to develop an electrostatic latent image formed on a photoconductor based on image information toner comprises a colored powder formed by a mold releasing agent dispersed and pulverized in two or more resin mixtures having a different degree of crosslinking, and the overall occupancy rate of the mold releasing agent present as a domain in one particle of said toner is 1 to 10%, and the average dispersion diameter of the mold releasing agent is 10 to 50% of the toner particle diameter.

Namely, the present invention uses two or more types of resin having a different degree of crosslinking, and defines the physical state of the mold releasing agent in the toner. This provides electrophotographic toner characterized by sufficient melting and fusing properties. Further, this toner provides an image featuring excellent gloss, color development, transparency, durability, and resistance against the offset phenomenon. Particularly, the toner according to the present invention is outstanding as a color electrophotographic toner.

DESCRIPTION OF THE PREFERRED EMBODIMENTS

Various embodiments according to the present invention will be described in greater detail.

Figure 1:
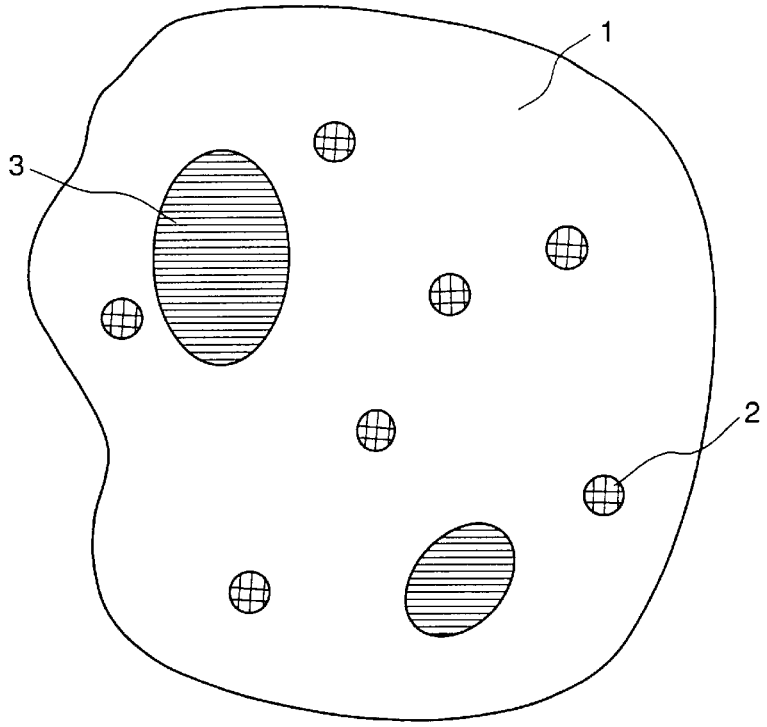
FIG. 1 is a diagram schematically representing the configuration of the toner according to the present invention.

As shown in the schematic cross sectional view of FIG. 1, toner according to the present invention consists of a coloring agent 2 and a mold releasing agent 3 dispersed in resin 1. For example, toner according to this invention is prepared by the method to be described below, without being restricted thereto; and, it can also be manufactured by the well-known melting and pulverization method.

First, resin 1, mold releasing agent 3, coloring agent 2, an electrostatic charge regulator and the like are uniformly dispersed and mixed by a known blender, such as a ball mill. Then, the mixture is melted and kneaded by an enclosed type kneader, or single screw or twin-screw type extruder, and it is cooled. Then, it is pulverized and classified. Fluidizer or the like can be added to the toner whenever required.

These steps provide a coloring agent having an average particle size of 5 to 15 microns, namely, toner according to the present invention. It can be used as a one-component developer.

In the case of a dry type two-component system developer composition, the toner is used as a carrier, namely, iron powder, ferrite, magnetite or resin is used as a core, and the core can be utilized as a developer composition. Or, the core can be blended with amorphous or ball-shaped magnetic powder coated with silicone resin, acryl resin, polyester resin or the like as required, and it can be used as a developer composition.

For example, resins 1 used for the toner of the present invention include polyester resin, styrene resin, acryl resin, styrene acryl resin, silicone resin, epoxy resin, diene resin, phenol resin, and ethylene vinyl acetate resin. Polyester resin is especially preferred from the view point of its melting properties and picture quality at the time of fusing.

It is preferred that two or more resins having a different degree of crosslinking be blended for use. It is also preferred to blend the resin having a lower degree of crosslinking as a major component with 5 to 50 parts by weight of resin having a higher degree of crosslinking. It is especially preferred to add the crosslinking (non-linear) polyester, which consists of the main component of a non-crosslinking (linear) polyester, and the constituent monomer of a tervalent or a high-valent monomer or crosslinking agent. This provides excellent offset resistance while maintaining superb durability, color development and transparency.

Two or more resins having a different degree of crosslinking are preferred to contain 5% or less of THF insoluble.

As described above, a non-crosslinking (linear) polyester is used as a main component. This is because, if the degree of crosslinking is increased excessively, the melt viscosity will be increased and the smoothness and gloss of the fusing image will be lost. However, a crosslinking (non-linear) resin is very effective in reducing hot offset occurring on the high temperature side and in improving durability. Therefore, if it is blended in such a ratio that the smoothness and gloss of the fusing image are not lost, it becomes easy to improve the offset resistance, while maintaining excellent durability, color development and transparency, wherein this is the biggest problem for an oil-less color toner.

The non-crosslinking (linear) polyester of the present invention can be polymerized normally by known processes of esterification and transesterification.

To put it more specifically, for example, condensation and polymerization are performed at the reaction temperature of 170 to 220° C. and a pressure of 5 mmHg to normal pressure by adding a catalyst as required (wherein the optimum temperature and pressure are determined by the reactivity of the monomer or the like), and the reaction is terminated when the specified physical properties have been reached.

Of the monomers constituting the polyester, the alcohol component, for example, includes ethylene glycol, diethylene glycol, triethylene glycol, 1,2-propylene glycol, 1,3-propylene glycol, 1,4-butane diol, neopentyl glycol, 1,4-butene diol, 1,5-pentane diol, 1,6-hexane diol and other diols.

Further, bisphenol A, hydrogenated bisphenol A, polyoxyethylene bisphenol A, polyoxypropylene bisphenol A, bisphenol A alkylene oxide adduct and other dihydric alcohols can be mentioned.

Of these, ethylene glycol, polyoxyethylene bisphenol A, and polyoxypropylene bisphenol A are preferred.

Aliphatic saturated dicarboxylic acid having a carbon number of 3 or more, or aliphatic non-saturated dicarboxylic acid having a carbon number of 5 or more and/or its acid hydride or lower alkyl ester are used as the acid component.

Aliphatic saturated dicarboxylic acid having a carbon number of three or more, for example, includes alkylsuccinic acids, such as succinic acid, adipic acid, sebatic acid, azelaic acid, malonic acid and n-dodesyl succinic acid. Further, this acid hydride or lower alkyl (carbon number: 1 to 5) ester is used.

Aliphatic unsaturated dicarboxylic acid having a carbon number of five or more, for example, includes alkenyl succinic acids, such as citraconic acid, itaconic acid, glutaconic acid and n-dodecenyl succinic acid. Further, this acid hydride or lower alkyl (carbon number: 1 to 5) ester is used.

In addition to said mandatory components, at least one type selected from aliphatic unsaturated fumaric acids such as maleic acid and fumaric acid having a smaller carbon number; aromatic dicarboxylic acid (phthalic acid, isophthalic acid, terefumaric acid, etc.); alicyclic dicarboxylic acid (cyclohexane dicarboxylic acid, etc.), and a group of these acid hydrides and lower alkyl (carbon number: 1 to 5) ester, can be used as an optional acid component.

In the above statement, the a mount of aliphatic dicarboxylic acid (restricted to a carbon number of 3 or more in the case of saturared dicarboxylic acid and a carbon number of 5 or more in the case of unsaturated dicarboxylic acid), or the acid anhydride or lower alkyl (carbon number: 1 to 5) ester in the acid component, is preferred to be within the range from 5 to 90 mol% in order to obtain the effect of the present invention.

The crosslinking polyester in the present invention is produced by using a tervalent or higher-valent monomer in addition to said divalent monomer, wherein any one of the monomers is provided with a lateral chain having a carbon number of 2 to 30.

The tervalent or higher-valent monomer includes trivalent carboxylic acid, such as trimellitic acid anhydride, 2,5,7-naphthalene and tricarboxylic acid, its derivative, and trihydric alcohol, such as glycerol and trimethyrol propane. The monomer provided with the lateral chain having a carbon number of 2 to 30 includes dodecenyl succinate anhydride.

When both are blended with each other, the difference of the softening point between the two is preferred to be 30° C. or less, more preferably to be 20° C. or less, and still more preferably to be 10° C. or less. Even if the softening point as a toner is the same, the difference in the softening point between the two is 40° C. or more, so that the gloss will be much deteriorated at the time of fusing. This is not suited for a color system.

To ensure conservation stability, the non-crosslinking (linear) polyester according to the present invention is preferred to have a glass transition temperature (Tg) of 50° C. or more. From the viewpoint of picture quality, its softening temperature (Tm) is preferred to be 90 to 140° C., more preferably to be 90 to 120° C. and still more preferably to be 95 to 110° C.

"Tg" can be measured by DSC (Differential Scanning Calorimetry). According to the present invention, the 910 Differential Scanning Calorimeter (by DuPont) is used to heat a sample from room temperature to 200° C. at the heating temperature rate of 10° C./min. The sample is then cooled down to room temperature. Then, it is again heated from room temperature to 200° C. at the heating temperature rate of 10° C./min.

Tg is defined as the temperature at the crossing point between the extension of the baseline of Tg or below in the second DSC curve and the tangential line representing the maximum inclination from the peak rising portion to the apex of the peak.

Tm is measured by an overhead flow tester. In accordance with the present invention, the following method is used for this measurement. While an overhead flow tester CFT-500 (by Shimazu Mfg.) is used to heat a 1 $cm^3$ sample at the heating rate of 6° C./min., a weight of 30 $kg/cm^2$ is applied by the plunger in such a way that a 1 mm-diameter, 1 mm long nozzle is pushed out. This draws a lowering rate (flow value) of the plunger—temperature curve. When the height of the S-letter curve is assumed as "h", the temperature corresponding to h/2, namely, the temperature where the half flows out, is defined as Tm.

The following description is directed to the mold releasing agent 3 used in the present invention. The mold releasing agent 3 to be used is a known one without any restriction. For example, a suitable agent includes paraffinic wax, such as low-molecular polypropylene, low-molecular polyethylene, ethylenebisamide and microcrystalline wax.

It is also possible to use natural wax, such as carnauba wax, candelilla wax, rice wax and montan wax, low-molecular polyolefin, higher fatty acid, such stearic acid, and metal salt of higher fatty acid amide. Such a substance is preferred to be incompatible with resin 1 and to have a melting point ranging from 70 to 90° C.

The melting temperature is preferred to be 10 to 20° C. higher than the temperature Tg of the resin 1 as a major component, and about 20 to 30° C. lower than the temperature Tm. If the melting point is reduced below 70° C., the reduction of durability and the occurrence of filming will be marked. This is not suitable for commercial use. If the melting point exceeds 90° C., the fusing temperature of the toner will be too high. This is not desirable in terms of picture quality and energy saving.

The mold releasing agent 3 dispersed in the toner can be broadly categorized into two types. The one type is absorbed or mixed in resin 1 and other components, such as the coloring agent 2, and the other type is present as a domain accompanied by the boundary in resin 1.

To prevent the offset phenomena and to separate the mold releasing agent from the toner, the mold releasing agent 3 which is present as a domain is effective. Therefore, to control the operation of the mold releasing agent 3, it is more important to control the physical state as a domain rather than the total amount of the mold releasing agent 3 to be added.

When the component of the mold releasing agent 3 is allowed to be dispersed in the optimum physical state in the resin 1 as the main component of the toner 1, it is possible to produce a toner which ensures excellent offset resistance and durability, as well as a good picture quality.

To put it more specifically, the overall occupancy rate of the mold releasing agent 3 present as a domain in one toner particle is 1 to 10%, and the average dispersion diameter of the mold releasing agent 3 is 10 to 50% of the diameter of said toner particle. The overall occupancy rate denotes a volume ratio between the sum overall of the domains present in one toner particle and the toner particles. The average dispersion diameter signifies an average of the dispersion diameters for each of these domains.

Figure 2:
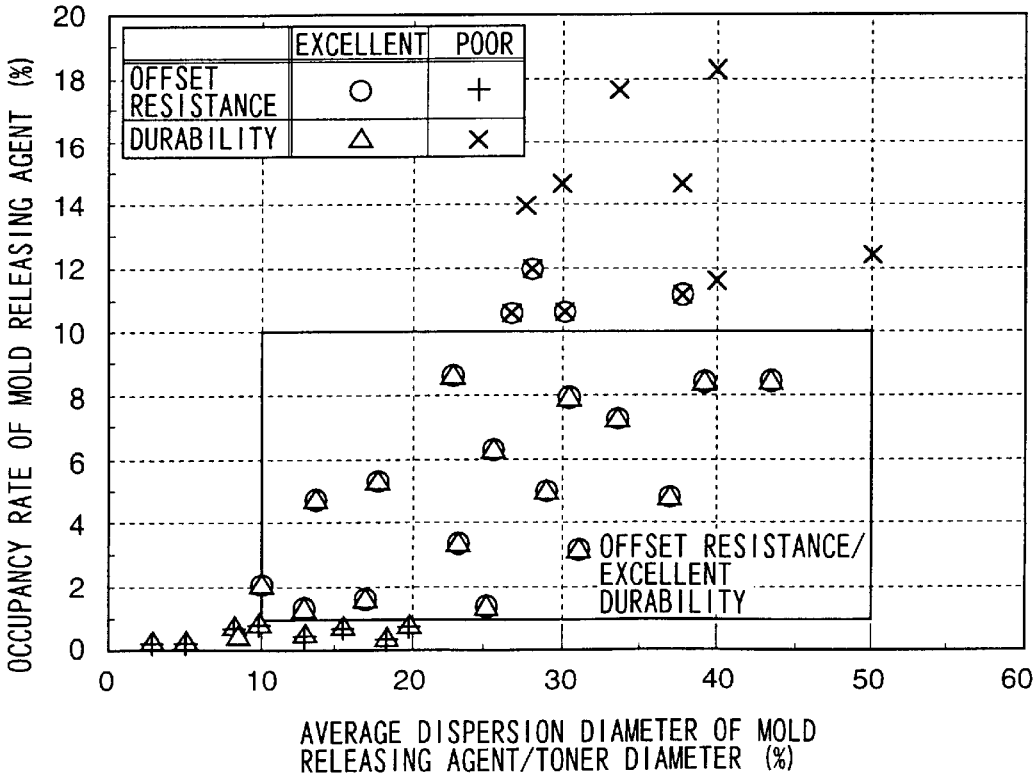
FIG. 2 is a chart representing the relationship between the mold releasing agent occupancy rate of toner and the offset resistance with respect to average dispersion diameter.

As shown in FIG. 2, the overall occupancy rate is reduced below 1%, and/or the average dispersion diameter is reduced below 10% of the toner diameter, and so, there is no oozing of the mold releasing agent 3 sufficient to prevent the offset phenomenon. Thus, a desired offset resistance cannot be gained.

When the overall occupancy rate has exceeded 10% and/or the average dispersion diameter 50% of the toner diameter, the toner durability decreases and filming on the photoconductor becomes remarkable. Neither of them is preferred.

In accordance with the present invention, the occupancy rate of the mold releasing agent present as a domain and the average diameter ratio of the mold releasing agent with respect to the toner diameter can be calculated according to the following procedure.

Mold releasing agent particles in the obtained toner are observed by a transmission electron microscope to calculate the average particle size of the mold releasing agent. The occupancy rate of the mold releasing agent present as a domain and the average diameter ratio of the mold releasing agent with respect to toner diameter are calculated according to the following equations (1) and (2).

In accordance with the present invention, in view of the error and particle size distribution of the particles, 100 to 200 particles are measured. In this case, it is preferred that 80 percent or more be within said range. More preferably, 90 percent or more is within said range. [Eq.1]

$$\text{Occupancy rate of mold releasing agent (\%)} = nd^3/D^3 \times 100 \quad (1)$$

$$\text{Average diameter ratio of mold releasing agent (\%)} = d/D \times 100 \quad (2)$$

(where d: average dispersion diameter of mold releasing agent, D: toner diameter, n: the number of mold releasing agent domains present in one toner particle)

The physical state of the mold releasing agent 3 can be controlled by the kneading conditions at the time of production, namely, by the kneading temperature, kneading time, kneading share and other factors. These conditions are not subjected to any restriction. They can be set appropriately according to the properties of the resin 1 and mold releasing agent 3 to be used.

The following description relates to the toner constituents other than the resin 1 and mold releasing agent 3. The toner according to the present invention contains a resin 1 and mold releasing agent 3 as described above. It also includes a coloring agent as an essential component.

A known organic pigment, dye or their combination can be used as coloring agent 2. Normally, an agent of the color corresponding to yellow toner, magenta toner or cyan toner is used.

In addition to the carbon black and nigrosin dye which have been used for monochrome, the following known dyestuffs and pigments can be listed: Azo dye (e.g. C.I. Solvent Yellow 2, 1, 4, 16, 19 and 60, C.I. Solvent Red 3, 8, 24 and 27), such dyestuffs as anthoraquinone dyestuff, indigo dyestuff, phthalocyanine dyestuff and xanthene dyestuff (e.g. C.I. Solvent Red 48 and 49), such organic pigments as benzimidazole pigment (e.g. C.I. pigment red 185), quinacridone pigment (e.g. C.I. pigment red 125, 207 and 209), phthalocyanine pigment (e.g. C.I. pigment blue 15, pigment green 7), isoindolinone pigment (e.g. C.I. pigment yellow 109 and 173), dioxazine pigment, (e.g. C.I. pigment violet 23), anthoraquinone pigment (e.g. C.I. pigment yellow 108, C.I. pigment red 177, C.I. pigment blue 6), perylene pigment (e.g. C.I. pigment orange 43), thioindogo pigment (e.g. C.I. pigment violet 38) and quinophthalone pigment (e.g. C.I. pigment yellow 153), and such inorganic pigments as titanium oxide, molybdenum red, chrome yellow, titanium yellow, chromium oxide and berlin blue.

These coloring agents are used independently or in two or more mixtures, wherein 0.1 to 10 parts by weight of them are used with respect to 100 parts by weight of resin.

In addition, the toner composition can include an electrostatic charge regulator, electrical conducting agent and flow improver as required, which are all known agents. For example, a low-molecular compound to a high-molecular compound (including polymer) can be used as a positive charge regulator without any restriction. Nigrosinbase EX as a nigrosin dyestuff, Oil Black BS and Oil Black SO (by Orient Chemical), triphenylmethane dyestuff, quaternary ammonium compound, and amino group based vinyl polymer can also be mentioned.

Metal complex salt of monoazo dyestuff, nitrohumic acid and its salt, substances with nitro group or halogen element, sulfonated copper phthalocyanine and maleic anhydride copolymer can be used as a negative charge regulator.

0.1 to 10 parts by weight of one or more of these electrostatic charge regulators are used with respect to 100 parts by weight of resin. These conducting agents include such conducting metal oxides as titanium oxide, aluminum oxide and magnetite.

The flow improver includes amorphous silica, fine powder of polytetrafluoroethylene and stearic acid zinc powder. 0.1 to 10 parts by weight of one or more of these substances can be used with respect to 100 parts by weight of resin.

Figure 3:
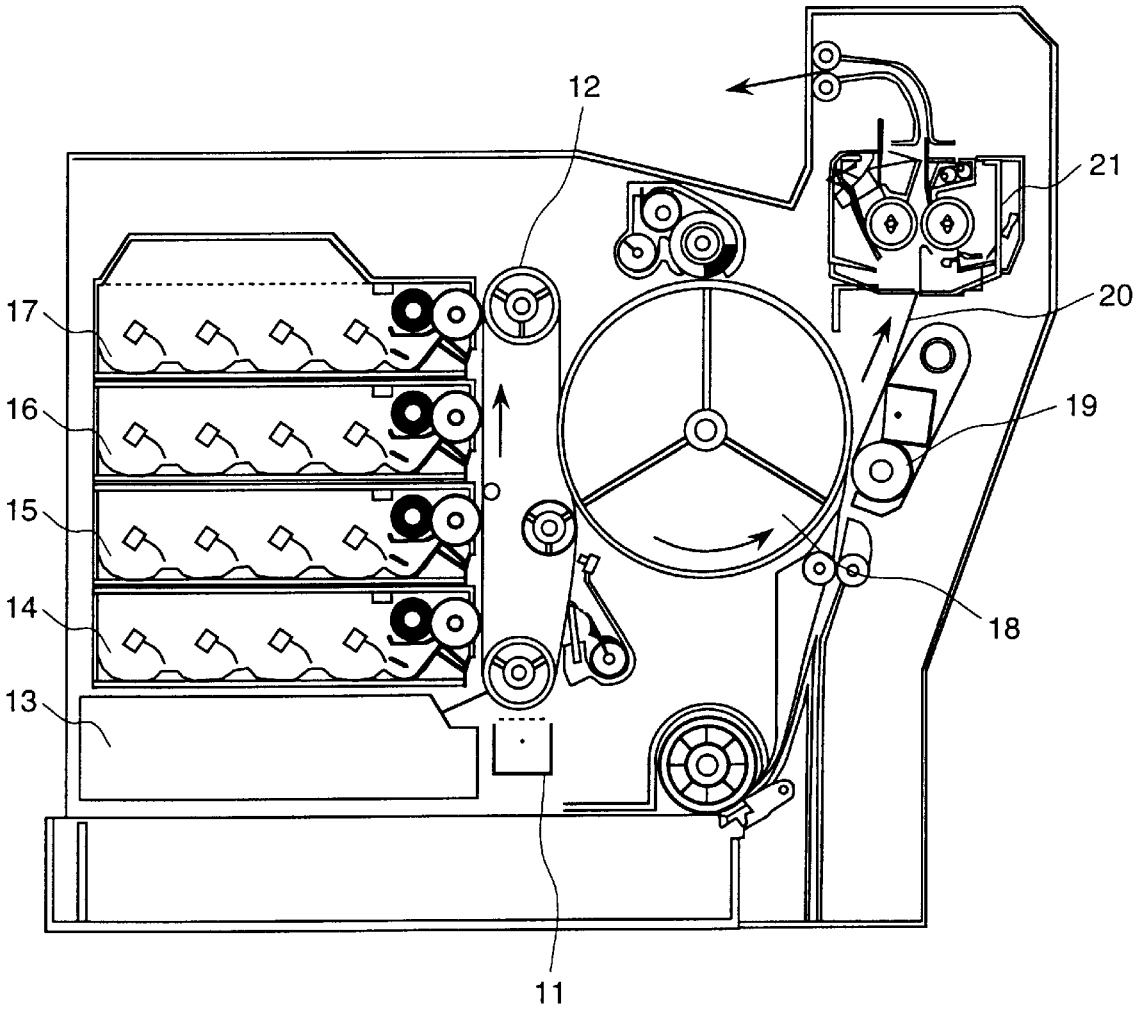
FIG. 3 is a diagram schematically representing the configuration of an electrophotographic image forming system according to the present invention.

FIG. 3 is a diagram schematically representing the configuration of one embodiment of the electrophotographic image forming system (electrophotographic system) used to verify the effect of the present invention. After toner is transferred onto the transfer paper in the transfer process, it is subjected to hot pressure fusing by a heating roller or the like. Then, toner is molten and colors are mixed in this electrophotographic system.

In response to signals from the controller (not illustrated), a specified electric charge is applied almost uniformly on the surface of the photoconductor 12 by the charging device 11. Then, an exposure device 13 is driven by control signals from said controller according to image information input from the outside, and the surface of the photoconductor 12 is exposed to light. Electric charge is removed from the portion exposed in this step, and an electrostatic latent image is formed on the surface of said photoconductor 12.

The electrostatic latent image formed on the photoconductor 12 is visualized by the toner charger in a polarity reverse to that of the electrostatic latent image accommodated in a development device (yellow) 14. The resultant visible image is transferred onto the intermediate transfer drum 18. Similarly, this step is followed using the development device (magenta) 15, development device (cyan) 16 and development device (black) 17, and a visible image is formed with four colors superimposed on said intermediate transfer drum 18.

Then, the visible image is transferred onto the recording media 20, such as a paper or plastic sheet, by the transfer device 19, and is heated and fused by the fusing device 21.

The fusing device 21 consists of a pair of rolls with a built-in heat source, namely, a heating roll and a pressure roll. The heating roll is provided with a coating layer such as silicone rubber, fluorine rubber, fluorine resin, polyimide, polyamide and polyamidimide, and has a built-in heater. The coasting layer is designed in a layered structure consisting of a heat resistant rubber, rubber based resin or these rubber layers coated with a resin layer. The above description also applies to the pressure roll. The present invention has no oil feed mechanism and performs hot pressure fusing without a mold releasing oil.

As described above, the toner according to the present invention does not require a mold releasing oil to be coated at the time of fusing. It provides an excellent oil-less fusing capability, and creates images characterized by superb gloss, color development and transparency.

The following describes the Embodiments and a Reference Example in greater detail. The mixture composition ratios in the embodiments are given in terms of parts by weight unless otherwise specified.

Embodiment 1

A twin-screw extruder was used to knead 5 parts of carnauba wax (melting point: 73° C.), three parts of each of the coloring agents comprising C.I. pigment yellow 17 as yellow toner, C.I. pigment red 12 as magenta toner, C.I. pigment blue 15:3 as cyan toner and carbon black as black toner, and two parts of electric charge regulator Bontron E-84 (by Orient Kagaku Kogyo), with respect to 70 parts of non-crosslinking (linear) polyester A (Tg: 60° C., softening temperature Tm: 100° C.) and 30 parts of crosslinking type (non-linear) polyester B (Tg: 61° C., Tm: 106° C.) to obtain a fine powder having an average particle diameter of 8 microns through the normal pulverization and classification steps after cooling.

The resulting product was subjected to surface treatment by Silica TS-530 (by Cabot) get the yellow, magenta, cyan and black toner.

The obtained toner was solidified by epoxy resin, was sliced into a thickness of about 1000 Angstrom by microstorm, and was observed by a transmission electron microscope. Table 1 shows the overall occupancy rate of the mold releasing agent for each particle of the toner of each color and the ratio of average dispersion diameter of the mold releasing agent with respect to the toner diameter.

TABLE 1

| | Toner | | Mold releasing agent | | |
|---|---|---|---|---|---|
| No. | Hue | Particle size (μm) | Average dispersion diameter (μm) | Average dispersion diameter ratio (%) | Overall occupancy rate (%) |
| Embodiment 1 | Yellow | 7.8 | 2.5 | 32 | 3 |
| | Magenta | 8.2 | 2.8 | 34 | 4 |
| | Cyan | 8.1 | 2.7 | 33 | 4 |
| | Black | 7.8 | 2.6 | 33 | 4 |
| Embodiment 2 | Yellow | 8.1 | 3.2 | 40 | 6 |
| | Magenta | 8.2 | 3.4 | 41 | 7 |
| | Cyan | 7.9 | 3.1 | 39 | 6 |
| | Black | 8.0 | 3.1 | 39 | 6 |
| Embodiment 3 | Cyan | 7.9 | 2.8 | 35 | 4 |
| Embodiment 4 | Cyan | 8.2 | 3.7 | 45 | 9 |
| Reference Example 1 | Magenta | 8.3 | 3.5 | 42 | 7 |
| Reference Example 2 | Cyan | 7.8 | 3.6 | 46 | 10 |
| Reference Example 3 | Cyan | 8.2 | 3.8 | 46 | 10 |
| Reference Example 4 | Cyan | 7.9 | 0.5 | 6 | 0.1 |
| Reference Example 5 | Cyan | 8.1 | 4.2 | 52 | 13 |

A fusing test was conducted using this toner. To put it more specifically, the fusing device was taken out of the device shown in FIG. 3 to create an image not yet fused. The amount of toner on paper was 1.5 to 1.6 mg/cm$^2$. A fusing test was conducted where this image was fused using an external fusing device.

The external fusing device mentioned herein refers to the fusing device taken out alone to function independently. The external fusing device, together with the heating roll and pressure roll, are designed to have a two-layer structure with fluorine resin coated on the silicone rubber. Its diameter is 32 mm, and the thickness of the coating layer is 1.5 mm.

The fusing speed was 70 mm/s, and temperature was regulated at intervals of 5° C. within the range of 100 to 180° C. To find the temperature range where the offset phenomenon does not occur, further fusing was carried out without oil being fed at all. As a result, for the toner of different colors, there is a wide fusable temperature area where offset does not occur, and this exhibits an excellent resistance to offset.

Then, the degree of gloss and OHP image transparency were evaluated for the image obtained by fusing 0.6 mg/cm$^2$ of toner on plain paper and monochrome OHP film at a processing speed of 70 mm/s at a fusing temperature of 150° C. The gloss was measured at a measuring angle of 75°/75° by a varied angle glossmeter VGS-300A (by Nihon Denshoku Kogyo).

A differential calorimeter SZΣ-98 (by Nihon Denshoku Kogyo) was used to measure the transparency of the OHP image. The transmittance at wavelengths of 700 nm was measured for the yellow and magenta toner. For cyan toner, the transmittance at wavelengths of 500 nm was measured. This test has demonstrated excellent glossiness and transparency for each tone.

To evaluate toner durability, the electrophotographic system shown in FIG. 3 was used to conduct a continuous printing test of 6,000 sheets. This test was performed at a processing speed of 100 mm/s according to the non-magnetic one-component development method. As a result, superb images could be obtained in a stable form wherein 6,000 sheets were successfully printed at an image density of 1.3 or more with a glossiness of 15 or more (incident angle: 75/75 deg.) without any fogging. Filming to the photoconductor, unsatisfactory cleaning or sticking to the blade, which is often a problem with the non-magnetic one-component development method, did not occur.

A blocking test was conducted where samples were left to stand for 18 hours at a humidity of 20, 45, 65 and 90% at 50° C. Blocking of the toner was not observed, and there was no preservation problem. Table 2 shows the result of evaluation.

TABLE 2

| No. | Hue | Offset resistance | Gloss/ transparency | Durability |
|---|---|---|---|---|
| Embodiment 1 | Yellow | ○ | ○ | ○ |
| | Magenta | ○ | ○ | ○ |
| | Cyan | ○ | ○ | ○ |
| | Black | ○ | ○ | ○ |
| Embodiment 2 | Yellow | ○ | ○ | ○ |
| | Magenta | ○ | ○ | ○ |
| | Cyan | ○ | ○ | ○ |
| | Black | ○ | ○ | ○ |
| Embodiment 3 | Cyan | ○ | ○ | ○ |
| Embodiment 4 | Cyan | ○ | ○ | ○ |
| Reference Example 1 | Magenta | ○ | x | ○ |
| Reference Example 2 | Cyan | ○ | x | ○ |
| Reference Example 3 | Cyan | x | — | ○ |
| Reference Example 4 | Cyan | x | — | ○ |
| Reference Example 5 | Cyan | — | — | x |

Embodiment 2

Toner of yellow, magenta, cyan and black was obtained in the same way as embodiment 1, except that 50 parts of non-crosslinking polyester A, 20 parts of non-crosslinking polyester C (Tg: 64° C., Tm: 110° C.) and 30 parts of crosslinking polyester were used as resins in place of 70 parts of non-crosslinking (linear) polyester A and 30 parts of crosslinking type (non-linear) polyester B. Table 1 shows the overall occupancy rate of the mold releasing agent for each particle of the obtained toner and the dispersion diameter ratio with respect to toner diameter.

The same test as in embodiment 1 was conducted using said toner. Excellent glossiness, OHP transparency, durability and offset resistance were ensured for the toner of each color. Table 2 shows the result of evaluation.

Embodiment 3

Cyan toner was obtained in the same way as embodiment 1, except that 5 parts of polyethylene wax (melting point: 80° C.) were used as a mold releasing agent in place of carnauba wax. Table 1 shows the overall occupancy rate of the mold releasing agent for each particle of the obtained toner and the dispersion diameter ratio with respect to toner diameter.

The same test as in embodiment 1 was conducted using said toner. Excellent glossiness, OHP transparency, durability and offset resistance were ensured. Table 2 shows the result of evaluation.

Embodiment 4

Cyan toner was obtained in the same way as embodiment 1, except that 10 parts of carnauba wax were used as a mold releasing agent. Table 1 shows the overall occupancy rate of the mold releasing agent for each particle of the obtained toner and the dispersion diameter ratio with respect to toner diameter.

The same test as in embodiment 1 was conducted using said toner. Excellent glossiness, OHP transparency, durability and offset resistance were ensured for the toner of each color. Table 2 shows the result of evaluation.

Reference Example 1

Magenta toner was obtained in the same way as embodiment 1, except that crosslinking type (non-linear) polyester D (Tg: 72° C., Tm: 140° C.) was used in place of crosslinking type (non-linear) polyester B. Table 1 shows the overall occupancy rate of the mold releasing agent for each particle of the obtained toner and the dispersion diameter ratio with respect to toner diameter.

The same test as in embodiment 1 was conducted using said toner. The durability and the fusable temperature range were commercially practical, but the gloss was poor with insufficient OHP image transparency.

Reference Example 2

Cyan toner was obtained in the same way as embodiment 1, except that 30 parts of non-crosslinking polyester A and 70 parts of crosslinking polyester were used as resins in place of 70 parts of non-crosslinking (linear) polyester A and 30 parts of crosslinking type (non-linear) polyester B. Table 1 shows the overall occupancy rate of the mold releasing agent for each particle of the obtained toner and the dispersion diameter ratio with respect to toner diameter.

The same test as in embodiment 1 was conducted using said toner. The durability was excellent and the fusable temperature range was commercially practical, but the gloss was poor with insufficient OHP image transparency.

Reference Example 3

Cyan toner was obtained in the same way as embodiment 1, except that 5 parts of polyethylene wax (melting point: 150° C.) were used as a mold releasing agent in place of carnauba wax. Table 1 shows the overall occupancy rate of the mold releasing agent for each particle of the obtained toner and the dispersion diameter ratio with respect to toner diameter.

The same test as in embodiment 1 was conducted using said toner. Excellent durability was obtained, but offset occurred in the total temperature range, resulting in fusing failure.

Reference Example 4

The same step as embodiment 1 was taken for the toner composition, and cyan toner was obtained by changing the kneading temperature at the time of toner production. Table 1 shows the overall occupancy rate of the mold releasing agent for each particle of the obtained toner and the dispersion diameter ratio with respect to toner diameter.

The same test as in embodiment 1 was conducted using said toner. Excellent durability was obtained, but offset occurred in the total temperature range, resulting in fusing failure.

Reference Example 5

The same step as embodiment 1 was taken for the toner composition, and cyan toner was obtained by changing the share of kneading rotation at the time of toner production. Table 1 shows the overall occupancy rate of the mold releasing agent for each particle of the obtained toner and the dispersion diameter ratio with respect to toner diameter.

The same test as in embodiment 1 was conducted using said toner. Filming occurred on the development blade to cause development failure. In the blocking test, the sample was left to stand for 18 hours, and toner was found to be completely blocked, presenting a problem in practical use.

According to the present invention, the deterioration of toner durability resulting from addition of the mold releasing agent can be minimized by combined use of two or more resin mixtures having a different degree of crosslinking.

Further, quick oozing out of the mold releasing agent in the fusing step is ensured by controlling the amount and average diameter of the mold releasing agent present as a domain in one particle of toner. This function provides toner characterized by a high offset resistance without oil being fed to the fusing device.

Separation and filming of the mold releasing agent can be prevented in development and transfer processes other than fusing. This feature provides a toner meeting the requirements of color development and transparency on higher dimensions, thereby solving the persisting issues inherent to the color system.

The present invention allows high performance toner to be produced according to a conventional kneading pulverization method at less cost, without using a special device or resin. This feature provides a small-sized maintenance-free electrophotographic system—an advantage of the present invention.

What is claimed:

1. Electrophotographic toner to visualize the electrostatic latent image formed on a photoconductor based on image information, wherein said toner comprises colored powder formed by mold releasing agent dispersed and pulverized in two or more resin mixtures having a different degree of crosslinking, the overall occupancy rate of mold releasing agent present as a domain in one particle of said toner is 1 to 10%, and the average dispersion diameter of mold releasing agent is 10 to 50% of the toner particle diameter.

2. Electrophotographic toner according to claim 1 characterized in that at least one of said resin mixtures is a linear resin.

3. Electrophotographic toner according to claim 1 characterized in that at least one of said resin mixtures is a polyester resin.

4. A method of producing electrophotographic toner to visualize the electrostatic latent image formed on a photoconductor based on image information characterized by preparation such that;

said toner comprises colored powder formed by mold releasing agent dispersed and pulverized in two or more resin mixtures having a different degree of crosslinking, the overall occupancy rate of mold releasing agent present as a domain in one particle of said toner is 1 to 10%, and the average dispersion diameter of mold releasing agent is 10 to 50% of the toner particle diameter

5. A electrophotographic image forming system wherein the toner image obtained by developing the electrostatic latent image formed on a photoconductor using electrophotographic toner according to any one of claims 1 to 3 is transferred and fused onto the recording media; said electrophotographic image forming system further characterized in that said toner is fused without oil being supplied to the heating member.

6. Electrophotographic toner according to any one of claims 1–3, wherein the electrophotographic toner is a color electrophotographic toner for use in a color electrophotographic printer and enables image formation with at least color development.

7. A method according to claim 4, wherein the electrophotographic toner is color electrophotographic toner for use in a color electrophotographic printer and enables image formation with at least color development.

8. An electrophotographic image forming system according to claim 5, wherein the electrophotographic image forming system is provided in a color electrophotographic printer, and the electrophotographic toner is color electrophotographic toner enabling image formation with at least color development.

* * * * *